US012286683B2

(12) United States Patent
Shibata et al.

(10) Patent No.: US 12,286,683 B2
(45) Date of Patent: Apr. 29, 2025

(54) HIGH-STRENGTH STEEL SHEET HAVING EXCELLENT DELAYED FRACTURE RESISTANCE

(71) Applicant: Kobe Steel, Ltd., Kobe (JP)

(72) Inventors: Kosuke Shibata, Kobe (JP); Junichiro Kinugasa, Kobe (JP); Keisuke Nakata, Kakogawa (JP); Atsuhiro Shiraki, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 504 days.

(21) Appl. No.: 17/790,890

(22) PCT Filed: Dec. 28, 2020

(86) PCT No.: PCT/JP2020/049182
§ 371 (c)(1),
(2) Date: Jul. 5, 2022

(87) PCT Pub. No.: WO2021/149463
PCT Pub. Date: Jul. 29, 2021

(65) Prior Publication Data

US 2023/0040459 A1 Feb. 9, 2023

(30) Foreign Application Priority Data

Jan. 21, 2020 (JP) ..... 2020-007808

(51) Int. Cl.
*C21D 9/46* (2006.01)
*C21D 8/02* (2006.01)
(Continued)

(52) U.S. Cl.
CPC ..... *C21D 9/46* (2013.01); *C21D 8/0236* (2013.01); *C21D 8/0273* (2013.01);
(Continued)

(58) Field of Classification Search
CPC ..... C21D 9/46; C21D 8/0236; C21D 8/0273; C21D 2211/008; C21D 1/18; C21D 1/19;
(Continued)

(56) References Cited

U.S. PATENT DOCUMENTS 8,449,988 B2 5/2013 Shiraki et al.
10,870,902 B2 12/2020 Ono et al.
(Continued)

FOREIGN PATENT DOCUMENTS

CN 106164319 A 11/2016
IN 201747028255 A 8/2017
(Continued)

OTHER PUBLICATIONS

International Preliminary Report on Patentability and Written Opinion issued Aug. 4, 2022 in PCT/JP2020/049182 (with English translation), 10 pages.
(Continued)

*Primary Examiner* — Adil A. Siddiqui
(74) *Attorney, Agent, or Firm* — Oblon, McClelland, Maier & Neustadt, L.L.P.

(57) ABSTRACT

A high-strength steel sheet with excellent delayed fracture resistance, having a tensile strength of 1700 MPa or larger, including a predetermined component composition, having a martensite structure whose ratio accounts for 95 area % or more of the entire metallographic structure, and having a transition metal carbide whose ratio accounts for 0.8 volume % or more of the entire metallographic structure.

2 Claims, 1 Drawing Sheet

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/14*** | (2006.01) |
| ***C22C 38/16*** | (2006.01) |

(52) U.S. Cl.
CPC ..... *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/14* (2013.01); *C22C 38/16* (2013.01); *C21D 2211/008* (2013.01)

(58) Field of Classification Search
CPC ... C21D 1/22; C21D 1/25; C21D 1/60; C21D 6/004; C21D 6/02; C21D 8/0205; C21D 8/0226; C21D 8/0247; C21D 8/0263; C21D 2211/004; C22C 38/001; C22C 38/002; C22C 38/02; C22C 38/04; C22C 38/06; C22C 38/08; C22C 38/14; C22C 38/16; C22C 38/50; C22C 38/42; C22C 38/54
See application file for complete search history.

(56) References Cited

U.S. PATENT DOCUMENTS

| | | | |
|---|---|---|---|
| 2011/0287280 | A1 | 11/2011 | Shiraki et al. |
| 2013/0040165 | A1 | 2/2013 | Shiraki et al. |
| 2016/0369367 | A1 | 12/2016 | Shiraki et al. |
| 2018/0100212 | A1 | 4/2018 | Ono et al. |
| 2019/0382864 | A1 | 12/2019 | Cho et al. |
| 2021/0062313 | A1 | 3/2021 | Seong et al. |
| 2022/0341012 | A1 | 10/2022 | Seong et al. |

FOREIGN PATENT DOCUMENTS

| | | | |
|---|---|---|---|
| JP | 5466576 | B2 | 4/2014 |
| JP | 6112261 | B2 | 4/2017 |
| JP | 2018-109222 | A | 7/2018 |
| KR | 10-2018-0074284 | A | 7/2018 |
| WO | WO 2018/123356 | A1 | 7/2018 |
| WO | WO 2019/132342 | A1 | 7/2019 |

OTHER PUBLICATIONS

Extended European Search Report issued Apr. 4, 2024 in European Patent Application No. 20915995.3, 13 pages.
International Search Report mailed on Mar. 23, 2021 in PCT/JP2020/049182 filed on Dec. 28, 2020 (2 pages).

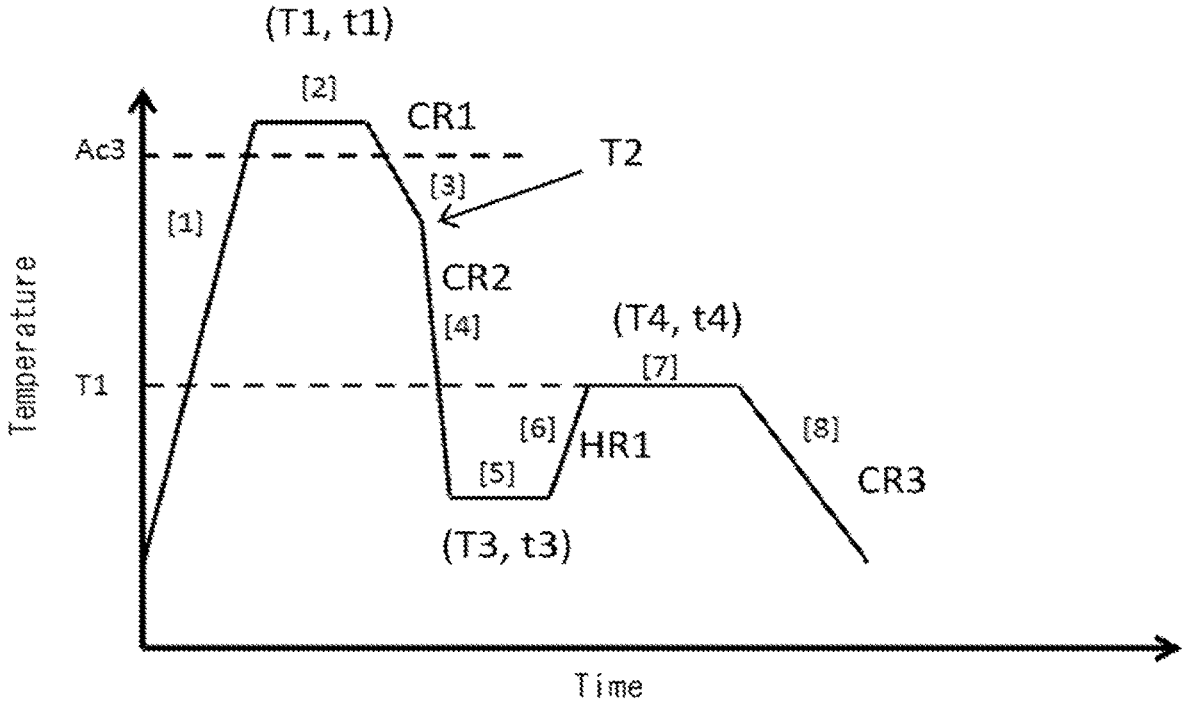
(T1, t1)
[2]
CR1
Ac3
T2
[3]
[1]
CR2
[4]
(T4, t4)
[7]
T1
[6]
HR1
[8]
[5]
CR3
(T3, t3)
Temperature
Time

HIGH-STRENGTH STEEL SHEET HAVING EXCELLENT DELAYED FRACTURE RESISTANCE

CROSS-REFERENCE TO RELATED APPLICATIONS

This application is a National Stage entry under 35 U.S.C. § 371 of PCT/JP2020/049182, filed on Dec. 28, 2020, and claims priority to Japanese Patent Application No. 2020-007808, filed on Jan. 21, 2020, the entire contents of which are incorporated herein by reference.

TECHNICAL FIELD

The present disclosure relates to a high-strength steel sheet that excels in delayed fracture resistance.

BACKGROUND ART

Steel sheets for automobile structural member and reinforcing member have been required to further enhance the strength, for the purpose of balancing between weight reduction and collision safety of automobile. Enhancement of the strength of steel sheet is, however, anticipated to induce delayed fracture, typically due to intrusion of hydrogen into the steel. Efforts for improving delayed fracture resistance have been made from various aspects, including a proposal of controlling morphology of precipitate in the steel, specifically through refinement of MnS or control of carbide density.

For example, Patent Literature 1 discloses a cold rolled steel sheet having a predetermined components, and satisfying an expression (1) that describes a relation between S and N, and having a structure in which: an area ratio of tempered martensite and bainite totals 95% or more and 100% or less of the entire structure; having 0.8 count/mm$^2$ or less of an inclusion group which is composed of one or more inclusion particles with a long axis of 0.3 μm or longer, stretched and/or dotted in row in the direction or rolling, with a distance between the inclusion particles, if there are multiple ones, of 30 μm or shorter, and having a total length of longer than 120 μm in the direction of rolling; having 3500 count/mm$^2$ or less of carbide mainly composed of Fe, with an aspect ratio of 2.5 or smaller, and a long axis of 0.20 μm or longer and 2 μm or shorter; having $0.7\times10^7$ count/mm$^2$ or more of a carbide of 10 to 50 nm in diameter, that distributes inside the tempered martensite structure and/or the bainite; and having a prior-y grain with an average grain size of 18 μm or smaller.

Patent Literature 2 discloses a high-strength cold rolled steel sheet that excels in bending workability, satisfying a predetermined component composition, whose steel structure being a simple martensitic structure, and having a specified arrangement of inclusion groups in a surficial layer that ranges from the surface of the steel sheet down to a depth of (sheet thickness×0.1).

CITATION LIST

Patent Literature

Patent Literature 1; Japanese Patent No. 6112261

Patent Literature 2; Japanese Patent No. 5466576

SUMMARY OF THE INVENTION

Technical Problems

Although Patent Literatures 1 and 2 discussed improvement of the delayed fracture resistance of the high-strength steel sheet, further examination would be necessary to improve the delayed fracture resistance of a steel sheet having still higher strength, particularly a steel sheet having a tensile strength of 1700 MPa or larger. The present disclosure has been made considering the circumstances, and an object of which is to provide a steel sheet well balanced between high strength represented by a tensile strength of 1700 MPa or larger, and excellent delayed fracture resistance.

Solution to Problems

A first aspect of the present invention relates to a high-strength steel sheet with excellent delayed fracture resistance, including:

C: 0.280 mass % or more and 0.404 mass % or less;
Si: 0 mass % or more and 0.6 mass % or less;
Mn: more than 0 mass % and 1.5 mass % or less;
Al: more than 0 mass % and 0.15 mass % or less;
B: 0.01 mass % or less;
Cu: 0.5 mass % or less;
Ni: 0.5 mass % or less;
Ti: 0.20 mass % or less;
N: more than 0 mass % and 0.01 mass % or less;
P: more than 0 mass % and 0.02 mass % or less; and
S: more than 0 mass % and 0.01 mass % or less, with the balance consisting of Fe and inevitable impurities, having a martensite structure whose ratio accounts for 95 area % or more of entire metallographic structure, having a transition metal carbide whose ratio accounts for 0.8 volume % or more of the entire metallographic structure, and having a tensile strength of 1700 MPa or larger.

A second aspect of the present invention relates to the high-strength steel sheet described in aspect 1, further containing Cr: more than 0 mass % and 1.0 mass % or less.

A third aspect of the present invention relates to the high-strength steel sheet described in aspect 1 or 2, further containing at least one selected from the group consisting of V: more than 0 mass % and 0.1 mass % or less;
Nb: more than 0 mass % and 0.1 mass % or less; and
Mo: more than 0 mass % and 0.5 mass % or less.

A fourth aspect of the present invention relates to the high-strength steel sheet described in any one of aspects 1 to 3, further containing at least one or two of:

Ca: more than 0 mass % and 0.005 mass % or less; and
Mg: more than 0 mass % and 0.005 mass % or less.

Advantageous Effects of Invention

Embodiments of the present invention can provide a steel sheet which is successfully well balanced between high strength represented by a tensile strength of 1700 MPa or larger, and excellent delayed fracture resistance.

BRIEF DESCRIPTION OF THE DRAWING

FIG. 1 is a drawing illustrating an annealing process in an embodiment of the present invention.

DESCRIPTION OF EMBODIMENTS

Aiming at solving the aforementioned problem, the present inventors conducted extensive studies to improve delayed fracture resistance of a steel sheet mainly composed of a martensitic structure, which is expected to have high strength, particularly ultra-high strength represented by a tensile strength of 1700 MPa or larger. The inventors consequently found that a transition metal carbide described later can effectively act as a hydrogen trap site, and that the transition metal carbide, whose content is kept at 0.8 vol % or more in the entire metallographic structure, can achieve excellent delayed fracture resistance represented by a fracture time of longer than 4 hours in a U-bend immersion test in hydrochloric acid described later.

Metallographic structure, component composition, and characteristics of the steel sheet according to the embodiments of the present invention, and a method for producing the steel sheet will be described in sequence below.

1. Metallographic Structure

The metallographic structure of the high-strength steel sheet has a martensite structure whose ratio accounts for 95 area % or more of the entire metallographic structure, and has a transition metal carbide whose ratio accounts for 0.8 volume % or more of the entire metallographic structure.

(1) Martensite Structure, with Ratio of 95 Area % or More

In the embodiment of the present invention, the ratio of the martensite structure, relative to the entire metallographic structure is given by 95 area % or more, aiming at keeping the tensile strength at 1700 MPa or larger. The ratio of the martensite structure is preferably 97 area % or more, and may even be 100 area %.

The high-strength steel sheet according to the embodiment of the present invention may contain ferrite structure, bainite structure, retained austenite structure or the like which could be inevitably included in the manufacturing process, besides the martensite structure.

(2) Transition Metal Carbide Amounts 0.8 Vol % or More

As described previously, it was found from the investigations aimed at improving resistance against delayed fracture due to hydrogen trapping in a ultra-high strength region represented by a tensile strength of 1700 MPa or larger, that a transition metal carbide which is an iron-based carbide can effectively act as a hydrogen trap site, in the embodiment of the present invention. The "transition metal carbide" in the embodiment of the present invention means a carbide mainly composed of Fe, that is, a carbide having Fe as the most abundant metal of all metal elements, and means epsilon carbide (ε) and eta carbide (η), but excluding cementite (θ). That is, the "transition metal carbide" in the embodiment of the present invention can also be expressed as "transition metal carbide (ε,η)" that collectively represents the epsilon carbide (ε) and the eta carbide (η). The transition metal carbide may further contain an element capable of forming the carbide (for example, Cr, V, etc.).

It was also found that 0.8 vol % or more of the transition metal carbide is necessary for making it effective as the hydrogen trap site. The content of the transition metal carbide is preferably 0.9 vol % or more, and more preferably 1.0 vol % or more. In the embodiment of the present invention, the total content of the epsilon carbide (ε) and the eta carbide (η) may only be 0.8 vol % or more, irrespective of proportion of the epsilon carbide (ε) and the eta carbide (η). The upper limit of the content of the transition metal carbide, although not specifically limited, is substantially about 3.0 vol %.

Although Patent Literature 1 describes shape control of carbides, the carbides described in Patent Literature 1 are different from the carbide according to the embodiment of the present invention. Patent Document 1 observes the carbides under a SEM, and defines the size to be 10 nm or larger. These carbides are, however, relatively coarse, and are therefore seemingly cementite, with poor hydrogen trapping ability. On the other hand, the transition metal carbide according to the embodiment of the present invention is a fine transition metal carbide having an equivalent circle diameter of 10 nm or smaller, which is not observable under a SEM. The transition metal carbide according to the embodiment of the present invention advantageously has the hydrogen trap ability higher than that of cementite, and can more effectively suppress hydrogen embrittlement.

Patent Literature 2 describes a martensitic structure steel in which inclusions are controlled. Patent Literature 2 does, however, not stand on a technical spirit of the embodiment of the present invention, such as causing micro-precipitation of the transition metal carbide with high hydrogen trapping ability by controlling the tempering described later, so that a tempering time of 100 seconds in Patent Literature 2 is considered to be too short to demonstrate a sufficient level of delayed fracture resistance.

2. Component Composition

The component composition of the high-strength steel sheet according to the embodiment of the present invention will be described below.

[C: 0.280 Mass % or More, 0.404 Mass % or Less]

C is an element necessary for obtaining a tensile strength of 1700 MPa or larger. Content of C is therefore set to 0.280 mass % or more. The content of C is more preferably 0.290 mass % or more, and even more preferably 0.300 mass % or more. Meanwhile, too much content of C excessively elevates the strength of the martensite structure, or produces coarse carbide such as cementite, thus degrading the delayed fracture resistance. The content of C is therefore set to 0.404 mass % or less. The content of C is preferably 0.380 mass % or less, and even more preferably 0.360 mass % or less.

[Si: 0 Mass % or More, 0.6 Mass % or Less]

Si is an element effective for improving the temper softening resistance. Si is also an element effective for enhancing the strength by solid solution strengthening. Content of Si, although possibly 0 mass %, is preferably 0.02 mass % or more, when intended for demonstrating the aforementioned effect. Too much content of Si which is a ferrite-forming element, however, degrades the hardenability, thus making it difficult to achieve high strength. The content of Si is therefore set to 0.6 mass % or less. The content of Si is preferably 0.5 mass % or less, more preferably 0.2 mass % or less, may further be 0.1 mass % or less, and may even further be 0.05 mass % or less.

[Mn: More than 0 Mass %, 1.5 Mass % or Less]

Mn is an element effective for improving the hardenability, and thus enhancing the strength. Content of Mn, expecting demonstration of this effect, is therefore set to more than 0 mass %. The content of Mn is preferably 0.1 mass % or more, more preferably 0.2 mass % or more, even more preferably 0.3 mass % or more, and yet more preferably 0.65 mass % or more. Excessive content of Mn, however, degrades the delayed fracture resistance and weldability, and also degrades corrosion resistance if not plated typically by electrogalvanizing. The content of Mn is therefore set to 1.5 mass % or less. The content of Mn is preferably 1.2 mass % or less, more preferably 1.0 mass % or less, and may further be 0.8 mass % or less.

[Al: More than 0 Mass %, 0.15 Mass % or Less]

Al acts as a deoxidizer, and also has an effect of improving corrosion resistance of the steel. Content of Al, expecting demonstration of the effect, is therefore set to more than 0 mass %. From the viewpoint of fully demonstrating the effect, the content of Al is preferably 0.035 mass % or more, and may further be 0.040 mass % or more. Excessive content of Al, however, produces a large amount of inclusions to cause surface defects, so that the upper limit thereof is set to 0.15 mass %. The content of Al is preferably 0.10 mass % or less, more preferably 0.07 mass % or less, and even more preferably 0.055 mass % or less.

[B: 0.01 Mass % or Less]

B is an element effective for enhancing the hardenability. Content of B, expecting full demonstration of the effect, is preferably set to more than 0 mass %, more preferably 0.0001 mass % or more, even more preferably 0.0005 mass % or more, and yet more preferably 0.0010 mass % or more. Excessive content of B, however, degrades the ductility, so that the content of B is set to 0.01 mass % or less, preferably 0.0080 mass % or less, more preferably 0.0065 mass % or less, and even more preferably 0.0040 mass % or less.

[Cu: 0.5 Mass % or Less]

[Ni: 0.5 Mass % or Less]

Cu and Ni are elements effective for improving the corrosion resistance of the steel sheet, therefore suppressing the generation of hydrogen possibly involved in hydrogen embrittlement, and improving the delayed fracture resistance. Content of Cu, expecting full demonstration of the effect, is preferably set to more than 0 mass %, more preferably 0.01 mass % or more, even more preferably 0.05 mass % or more, and yet more preferably 0.08 mass % or more. Meanwhile, excessive content of Cu degrades the pickling property and chemical convertibility, so that the content of Cu is set to 0.5 mass % or less, preferably 0.4 mass % or less, and even more preferably 0.2 mass % or less. Also content of Ni is preferably set to more than 0 mass %, more preferably 0.01 mass % or more, even more preferably 0.05 mass % or more, and yet more preferably 0.08 mass % or more. Excessive content of Ni, however, degrades the ductility and workability of the base material, so that the content of Ni is set to 0.5 mass % or less, preferably 0.4 mass % or less, and more preferably 0.2 mass % or less.

[Ti: 0.20 Mass % or Less]

Ti is an element effective for improving the strength, and for improving the toughness after hardening as a result of refinement of y-grain. Content of Ti, expecting demonstration of the effect, is preferably set to more than 0 mass %. Content of Ti, expecting full demonstration of the effect, is preferably set to 0.003 mass % or more, more preferably 0.020 mass % or more, and even more preferably 0.045 mass % or more. Excessive content of Ti, however, increases precipitation of carbonitride and so forth, thus degrading the workability of the base material. The content of Ti is therefore set to 0.20 mass % or less, and more preferably to 0.15 mass % or less.

[N: More than 0 Mass %, 0.01 Mass % or Less]

Excessive content of N increases precipitation of nitride, thus adversely affecting the toughness. The content of N is therefore set to 0.01 mass % or less. The content of N is preferably 0.008 mass % or less, and more preferably 0.006 mass % or less. The content of N is practically 0.001 mass % or more, in consideration of costs for steelmaking and so forth.

[P: More than 0 Mass %, 0.02 Mass % or Less]

P acts to strengthen the steel but degrades the toughness and ductility, so that the content thereof is set to 0.02 mass % or less. The content of P is preferably 0.01 mass % or less, and more preferably 0.006 mass % or less.

[S: More than 0 Mass %, 0.01 Mass % or Less]

S produces a sulfide-based inclusion, and degrades the workability and weldability of the base material. The content of S is therefore preferably as small as possible, and is set to 0.01 mass % or less in the embodiment of the present invention. The content of S is preferably 0.005 mass % or less, and more preferably 0.003 mass % or less.

[Balance]

The balance consists of Fe and inevitable impurities. Acceptable contamination of the inevitable impurity includes trace elements (for example, As, Sb, Sn, etc.) possibly entrained typically due to circumstances involving raw material, structural member, or manufacturing facility. Note that, there are elements generally considered to be the inevitable impurities since the lesser the content thereof the better, but the compositional ranges are separately specified as described above, such as P and S. Hence, the "inevitable impurity" that composes the balance in the context of the present patent specification is understood to exclude such elements whose compositional ranges are separately specified.

The steel sheet according to the embodiment of the present invention may only have a component composition that involves the aforementioned elements, and the balance consisting of Fe and inevitable impurities, and does not always necessarily contain the optional elements described below. However with the component composition of the steel sheet containing the optional elements described below, together with the aforementioned elements, the steel sheet will have further improved characteristics including strength and corrosion resistance.

[Cr: More than 0 Mass %, 1.0 Mass % or Less]

Cr is an element effective for improving the hardenability, and thus enhancing the strength. Cr is an element also effective for increasing the temper softening resistance of the martensitic structure steel. Content of Cr, expecting full demonstration of these effects, is preferably set to more than 0 mass %, more preferably 0.01 mass % or more, and even more preferably 0.05 mass % or more. Excessive content of Cr, however, degrades the delayed fracture resistance, so that the upper limit thereof is set to 1.0 mass %, and the preferred upper limit is set to 0.7 mass %.

[At Least One Selected from Group Consisting of V: More than 0 Mass %, 0.1 Mass % or Less; Nb: More than 0 Mass %, 0.1 Mass % or Less; and Mo: More than 0 Mass %, 0.5 Mass % or Less]

All of V, Nb and Mo are elements effective for improving the strength, and for improving the toughness after hardening as a result of refinement of y-grain. Contents of all of V, Nb and Mo, expecting full demonstration of the effect, are preferably set to more than 0 mass %, more preferably 0.003 mass % or more, and even more preferably 0.020 mass % or more. Excessive contents of the elements, however, increase precipitation of carbonitride and so forth, thus degrading the workability of the base material. Hence, the content of each of V and Nb is preferably set to 0.1 mass % or less, and more preferably 0.05 mass % or less, meanwhile the content of Mo is preferably set to 0.5 mass % or less.

[One or Two of Ca: More than 0 Mass %, 0.005 Mass % or Less, and Mg: More than 0 Mass %, 0.005 Mass % or Less]

Ca is an element capable of combining, in place of Mn, with S, controlling the geometry of MnS that extends in the direction of rolling, dividing MnS at the end face of the steel sheet to suppress localization of origin of local corrosion, and suppressing generation and intrusion of hydrogen at the origin of local corrosion. Meanwhile, Mg is an element capable of combining with O to form MgO, thus suppressing pH from lowering at the front of corrosion, and suppressing generation and intrusion of hydrogen. Content of either Ca or Mg, expecting full demonstration of these effects, is preferably set to more than 0 mass %, more preferably 0.0010 mass % or more, and even more preferably 0.0015 mass % or more. Excessive contents of these elements, however, degrade the workability, so that the content of each element is set to 0.005 mass % or less, and more preferably 0.003 mass % or less.

The steel sheet according to the embodiment of the present invention may further contain any of other elements such as Se, As, Sb, Pb, Sn, Bi, Zn, Zr, W, Cs, Rb, Co, La, Tl, Nd, Y, In, Be, Hf, Tc, Ta or O, up to a total content of 0.01 mass % or less, for the purpose of further improving corrosion resistance or delayed fracture resistance.

The steel sheet according to the embodiment of the present invention satisfies a strength (TS) of 1700 MPa or larger, and demonstrates excellent delayed fracture resistance such as represented by a fracture time of longer than 4 hours in a U-bend immersion test in hydrochloric acid described later.

3. Manufacturing Method

A recommended method for manufacturing the high-strength steel sheet according to the embodiment of the present invention will be described below.

The present inventors found that the high-strength steel sheet having the aforementioned desired metallographic structure and exhibiting desired characteristics is obtainable, by subjecting a rolled sheet such as hot-rolled steel sheet or cold-rolled steel sheet, having the aforementioned component composition, to heat treatment including annealing, hardening, and tempering detailed below. The recommended manufacturing method will be detailed below.

Any of widely accepted conditions are employable, except for the annealing, hardening, and tempering. Hence, in a case where a cold-rolled steel sheet is used as the steel sheet to be subjected to heat treatment, the cold-rolled steel sheet is obtainable by melting steel according to a usual method, continuously casting the melt to obtain a steel ingot such as a slab, heating the slab at approximately 1100° C. to 1250° C., hot rolling the slab, followed by winding, pickling, and cold rolling. The subsequent heat treatment will be detailed below, referring to FIG. 1 that illustrates an exemplary heat treatment process involved in the manufacture of the steel sheet of the present embodiment.

[Annealing: Heating at Maximum Heating Temperature T1 at or Above Ac3 and 950° C. or Below, Heating for Holding Time t1 of 30 Seconds or Longer]

As indicated by [1] and [2] in FIG. 1, the steel sheet is heated to a maximum heating temperature T1 in the range from point Ac3 to 950° C., and held in the temperature range for a holding time t1 of 30 seconds or longer. By heating in the temperature range, so as to cause full reverse transformation of the structure of the rolled sheet, it now becomes possible in the subsequent hardening process to constantly obtain a structure in which the martensite structure accounts for 95 area % or more. The holding time t1 at the maximum heating temperature T1 may be determined typically depending on the maximum heating temperature T1, wherein the aforementioned time of 30 seconds or longer is intended for completing austenite transformation of the steel sheet in the temperature range from point Ac3 to 950° C. If the maximum heating temperature T1 is lower than point Ac3, or if the holding time t1 in the temperature range is shorter than 30 seconds, the structure (for example, ferrite-pearlite) of the rolled sheet to be heat-treated, such as hot-rolled steel sheet, would remain, so that the subsequent hardening would fail in obtaining the martensitic structure, thus making it difficult to obtain a tensile strength of 1700 MPa or larger. Meanwhile, if the maximum heating temperature T1 exceeds 950° C., austenite grains would grow to form a coarse structure, which adversely affects mechanical characteristics and delayed fracture resistance. Holding at excessively high temperatures is not preferred, also since the facility load would increase, thus degrading the economic efficiency. The maximum heating temperature T1 is therefore set to 950° C. or below.

Point Ac3 is calculated by the following equation (1) (see "Physical Metallurgy of Steels", by William C. Leslie, 1985, p. 273, Equation (VII-20)).

$$Ac3(^\circ C.)=910-203\times[C]^{1/2}-15.2\times[Ni]+44.7\times[Si]+104\times[V]+31.5\times[Mo]+13.1\times[W]-30\times[Mn]-11\times[Cr]-20\times[Cu]+700\times[P]+400\times[Al]+120\times[As]+400\times[Ti] \quad (1)$$

In equation (1), [element name] represents the content of each element in steel in mass %, where zero is assigned for any element not contained.

[Hardening: Cooling at 50° C./s (Sec) or Faster from Hardening Start Temperature of 600° C. or Higher]

As indicated by [3] and [4] in FIG. 1, the steel is cooled from the maximum heating temperature T1 down to hardening heating temperature (quenching start temperature) T2, and then hardened by quenching it from the hardening start temperature T2, to obtain a martensite-predominant structure, that is, a metallographic structure in which the ratio of the martensite structure accounts for 95 area % or more. The hardening start temperature T2 is set to 600° C. or higher. The hardening start temperature T2, if set below 600° C., causes excessive production of ferrite in the base composed of martensitic structure, making it difficult to enhance the strength and delayed fracture resistance. The hardening start temperature T2 is preferably 700° C. or higher, more preferably 800° C. or higher, and is not higher than the maximum heating temperature T1.

Average cooling rate CR2 is set to approximately 50° C./s or faster. The hardening typically relies upon water cooling. If the average cooling rate CR2 is slower than the aforementioned rate, ferrite would precipitate during the cooling, so that the martensitic structure would not be obtainable, thus failing to keep the tensile strength at 1700 MPa or larger. On the other hand, excessive increase in the average cooling rate CR2, although not harmful to material quality, requires unnecessarily large capital investment, so that the average cooling rate CR2 is set to approximately 1000° C./s or below. Cooling stop temperature T3, in a case where the cooling relies upon water cooling, is approximately 100° C. or below. Although the effects according to the embodiment of the present invention may be demonstrated without special limitation on the lower limit of the cooling stop temperature T3, the lower limit is substantially set to room temperature, since setting below room temperature would increase the economic load.

Average cooling rate CR1 from the maximum heating temperature T1 to the hardening start temperature T2, indicated by [3] in FIG. 1, is set to 5° C./s or faster. The faster the average cooling rate CR1, the better, and may be equal to the average cooling rate CR2 during hardening. That is, the steel may alternatively be hardened typically by cooling from the maximum heating temperature T1 (=hardening start temperature T2) down to the cooling stop temperature T3, at an average cooling rate CR2 of 50° C./s or faster, without providing the cooling step [3] in FIG. 1.

The holding time t3 at the cooling stop temperature T3 is of no great importance, instead that the steel may be held at the cooling stop temperature T3 as indicated by [5] in FIG. 1, or not necessarily be held at the cooling stop temperature T3. When held at the cooling stop temperature T3, the holding time t3 is preferably set to 1 to 600 seconds. The holding time t3 is preferably set to 600 seconds or shorter, since the characteristics of the obtainable steel sheet would not improve so much, even if the holding time is prolonged longer than 600 seconds, but degrading the productivity of the steel sheet.

[Tempering]

Tempering comes next, as indicated by [6] to [8] in FIG. 1. By appropriately controlling the temperature and time of tempering, it now becomes possible to control precipitation and growth of the Fe-based carbide which is the transition metal carbide according to the embodiment of the present invention, and to constantly achieve the content of the transition metal carbide at a level of 0.8 vol % or more.

(Heating from Cooling Stop Temperature T3 Up to Tempering Temperature T4, at Reheating Rate HR1 of 1.0° C./s or Faster)

As indicated by [6] in FIG. 1, the steel is heated from the cooling stop temperature T3 up to tempering temperature T4, at a reheating rate HR1 of 1.0° C./s or faster. The heating is conducted at the aforementioned rate, since slow reheating rate HR1 would coarsen the carbide that precipitates during the tempering. The reheating rate HR1 is preferably 5.0° C./s or faster. By increasing the reheating rate, the carbide becomes finer, so that the delayed fracture resistance improves. The upper limit of the reheating rate, although not specifically limited, may be set to 250° C./s, for example.

(Heating at Tempering Temperature T4 at which Predetermined Tempering Parameter Satisfies Range from 130 to 200, for Tempering Time t4 of Longer than 100 Seconds, and Shorter than 1000 Seconds)

The tempering is conducted by setting the tempering temperature T4 so that a predetermined tempering parameter defined by equation (2) will satisfy the range from 130 to 200, and by holding the steel at the temperature T4, for a duration (tempering time) of longer than 100 seconds, and shorter than 1000 seconds.

$$\text{Tempering parameter} = -160 \times [C] + T4 \quad (2)$$

In equation (2), [C] represents the content of C (mass %) in the steel, and T4 represents the tempering temperature (° C.).

For precipitation of a predetermined amount of the transition metal carbide featured by the present disclosure, the tempering temperature needs to be controlled taking the C content into account. The present disclosure is different from the prior art unconscious of this point. That is, the prior art is not considered to cause precipitation of a predetermined amount of the transition metal carbide such as specified by the embodiment of the present invention, presumably making it difficult to balance high strength represented by a tensile strength of 1700 MPa or larger, and excellent delayed fracture resistance.

The embodiment of the present invention successfully causes precipitation of a predetermined amount of fine transition metal carbide, by appropriately conducting the tempering as described above. With the tempering parameter smaller than 130, the content of the transition metal carbide will become poor due to insufficient diffusion of C, and the delayed fracture resistance characteristics will become insufficient. The tempering parameter is preferably 135 or larger, more preferably 140 or larger, and even more preferably 145 or larger. Meanwhile, the tempering parameter exceeding 200 would reduce the strength, or produce a large amount of coarse cementite, and would degrade the delayed fracture resistance. The tempering parameter is preferably 190 or smaller.

With a tempering time t4 of 100 seconds or shorter, C would diffuse poorly, making it difficult to obtain excellent delayed fracture resistance, even if the conditions for the tempering parameter were satisfied. The tempering time t4 is therefore set to longer than 100 seconds, preferably longer than 240 seconds, and more preferably longer than 360 seconds. Meanwhile, the tempering time t4 is set to shorter than 1000 seconds, preferably shorter than 800 seconds, and more preferably shorter than 600 seconds, since prolonged holding at the tempering temperature T4 will be economically disadvantageous.

Next, as indicated by [8] in FIG. 1, the steel after tempered may only be cooled down to a temperature below 100° C., such as room temperature, typically by allowing it to stand for cooling. Average cooling rate CR3 during the cooling is typically set to 20° C./sec or slower, and also typically set to 10° C./sec.

[Plating]

The steel sheet, thus obtained by heat treatment and subsequent cooling down to room temperature, may be subjected to electrogalvanizing according to a usual method. The steel sheet may alternatively be subjected to hot-dip galvanizing or alloyed zinc plating according to a usual method. These plating processes will not adversely affect the strength and delayed fracture resistance required in the embodiment of the present invention, if the aforementioned component composition, the metallographic structure, and the recommended manufacturing method of the embodiment of the present invention are satisfied.

The electrogalvanizing may be conducted typically by energizing the steel sheet, obtained after the heat treatment, while being immersed in a zinc solution at 50 to 60° C. Amount of adhesion of the plating is typically, but not specifically limited to, approximately 10 to 100 g/m$^2$ per side. As a result of electrogalvanizing, corrosion resistance of the steel sheet improves.

EXAMPLES

Embodiments of the present invention will be described more specifically below, with reference to Examples. The embodiments of the present invention are not limited by the following examples, and may instead be implemented with appropriate modifications within the scope conforming to the aforementioned and later-described spirit, wherein all of such modifications fall within the technical scope of the present invention.

Steels having respective component compositions listed in Table 1 were melted in a vacuum induction furnace (VIF) at a laboratory. "Tr" in Table 1 represents trace amount (trace) below the quantification limit. Each steel sheet was subjected to hot rough rolling, further heated at 1200 to 1250° C. for 30 minutes, then finish-rolled, held in an atmospheric furnace at 500 to 650° C. for 30 minutes (for simulating winding), and then cooled down to room temperature, to prepare a hot-rolled steel sheet 2 to 3 mm in thickness. The steel sheet was thereafter pickled, further followed by cold rolling, to obtain a cold-rolled steel sheet 1.0 mm in thickness.

Each cold-rolled steel sheet was then subjected to annealing, water hardening, and tempering under heat treatment conditions summarized in Table 2, to obtain a steel sheet.

"Cooling method" in Table 2 represents a method of cooling that starts at the hardening start temperature T2. Heat treatment conditions other than those summarized in Table 2 are as follows. The cooling was conducted with a goal of room temperature as the cooling stop temperature T3. The holding time t3 at the cooling stop temperature T3 was not controlled, since it is of no great importance as described previously. The reheating rate HR1 was set to approximately 2° C./s. After tempering, the steel was allowed to stand for cooling down to room temperature.

Each of the obtained steel sheet was evaluated in terms of the ratio of metallographic structure, the content of transition metal carbide, and the characteristics represented by tensile strength and delayed fracture resistance.

[Measurement of Proportion (Area Ratio) of Metallographic Structure]

A 1.0 mm×10 mm×5 mm test specimen was polished on a cross section that lies in parallel to the rolling direction, corroded with nital solution, and then observed at a depth of (¼)t (t=thickness) under a scanning electron microscope (SEM) at a 2000× magnification. Regions looked bright were defined to have martensite structure, and regions looked dark were defined to have ferrite structure. Ten lines were drawn at regular intervals in both of vertical and horizontal directions in a freely selected field of view (having a size of 90 μm×120 μm), and the number of intersections that fell on the martensite structure, and the number of intersections that fell on the structure other than the martensite structure (ferrite structure), were individually divided by the number of all intersections, to determine the area ratio of the martensite structure, and the area ratio of the structures other than the martensite structure (ferrite structures).

[Measurement of Content of Transition Metal Carbide]

The steel sheet was worked by electrospark machining to produce a rod-like steel piece 0.5 mm in diameter and 25 to 30 mm in length, and then finished by electrolytic polishing to obtain a test specimen approximately 0.2 mm in diameter and 25 to 30 mm in length. The test strip was measured by X-ray diffractometry. The X-ray diffractometry was conducted with use of an X-ray diffractometer aligned to the industrial beam line BL19B2 of SPring-8, at an energy of 25 keV. The obtained diffraction peaks were analyzed by the Rietveld method to determine the content of transition metal carbide. The transition metal carbides η and ε, which are known to be effective as hydrogen trap sites, have similar structures, and are difficult to distinguish on the basis of the diffraction peaks. In the present analysis, all peaks not clearly attributable to η or ε were assumingly attributed to η carbide, to quantify the content of transition metal carbide by the Rietveld method.

Since the method for measuring the area ratio of the metallographic structure is different from the method for measuring the content of transition metal carbide as described above, so that the total of the area ratio of the metallographic structure and the amount of transition metal carbide may exceed 100%.

[Evaluation of Tensile Property]

The tensile strength (TS) was measured according to the method specified in JIS Z2241 (2011), with use of a JIS No. 5 tensile test specimen sampled from the steel sheet while aligning the longitudinal direction with the direction normal to the rolling direction of the steel sheet. In this Example, samples that demonstrate a tensile strength of 1700 MPa or larger were evaluated as having high strength.

[Evaluation of Delayed Fracture Resistance (U-Bend Immersion Test in Hydrochloric Acid)]

The obtained steel sheet was cut to prepare two test specimens 150 mm in width and 30 mm in length. Each test specimen was milled at the cut end face, bent with a punch and a die into U shape with a bending radius of 10 mm, to prepare two U-bend specimens having a stress of 1500 MPa applied to the bent crown. Each of the U-bend specimens was immersed in 0.1 N HCl, and the time to crack was measured. Cases where a crack was visually observed were judged as "cracked". In a case where the test results are different between two U-bend specimens, the test result from the one demonstrating shorter time to crack was employed. In this Example, the samples demonstrating a time to crack of longer than 4 hours were evaluated to have excellent delayed fracture resistance.

The results of measurement are summarized Table 3. In Tables 1 and 3, underlined numerals indicate deviation from the specified ranges and evaluation criteria of the embodiments of the present invention. In Table 2, the underlined items indicate deviation from the recommended conditions for manufacturing.

TABLE 1

| Steel | Component composition (mass %) Balance consists of iron and inevitable impurities | | | | | | | | | | | | | Point |
|---|---|---|---|---|---|---|---|---|---|---|---|---|---|---|
| type | C | Si | Mn | P | S | Al | Cu | Ni | Cr | Ti | B | N | Ca | Ac3 |
| A | 0.230 | 0.03 | 1.09 | <0.005 | <0.0005 | 0.041 | 0.11 | 0.10 | 0.08 | 0.051 | 0.0021 | 0.0040 | Tr | 801 |
| B | 0.279 | 0.21 | 0.93 | <0.004 | 0.0010 | 0.040 | 0.11 | 0.11 | 0.01 | 0.100 | 0.0024 | 0.0037 | 0.0028 | 822 |
| C | 0.307 | 0.20 | 0.93 | 0.007 | 0.001 | 0.039 | 0.10 | 0.10 | <0.01 | 0.100 | 0.0031 | 0.0039 | 0.0022 | 816 |
| D | 0.327 | 0.02 | 0.71 | <0.005 | <0.0005 | 0.042 | 0.11 | 0.12 | 0.08 | 0.053 | 0.0019 | 0.0034 | Tr | 791 |
| E | 0.356 | 0.20 | 0.91 | 0.005 | <0.0005 | 0.040 | 0.10 | 0.14 | <0.01 | 0.109 | 0.0025 | 0.0039 | 0.0015 | 810 |
| F | 0.407 | 0.20 | 0.92 | 0.005 | 0.0012 | 0.040 | 0.10 | 0.10 | <0.01 | 0.100 | 0.0029 | 0.0034 | 0.0025 | 797 |

TABLE 2

| No. | Steel type | Annealing temperature T1 (° C.) | Annealing time t1 (s) | Hardening heating temperature T2 (° C.) | Cooling method | Tempering temperature T4 (° C.) | Tempering time t4 (s) | Tempering parameter |
|---|---|---|---|---|---|---|---|---|
| 1 | A | 900 | 175 | 900 | Water cooling | — | — | — |
| 2 | A | 900 | 175 | 900 | Water cooling | 160 | 435 | 123 |
| 3 | B | 900 | 175 | 900 | Water cooling | 160 | 435 | 115 |

TABLE 2-continued

| No. | Steel type | Annealing temperature T1 (° C.) | Annealing time t1 (s) | Hardening heating temperature T2 (° C.) | Cooling method | Tempering temperature T4 (° C.) | Tempering time t4 (s) | Tempering parameter |
|---|---|---|---|---|---|---|---|---|
| 4 | C | 900 | 175 | 900 | Water cooling | 200 | 435 | 151 |
| 5 | D | 900 | 175 | 900 | Water cooling | 240 | 435 | 188 |
| 6 | E | 900 | 175 | 900 | Water cooling | 240 | 435 | 183 |
| 7 | E | 900 | 175 | 900 | Water cooling | 270 | 435 | 213 |
| 8 | F | 900 | 175 | 900 | Water cooling | 270 | 435 | 205 |

TABLE 3

| No. | Ratio of martensite structure (area %) | Content of transition metal carbide (volume %) | TS (MPa) | Time to fracture (hr) |
|---|---|---|---|---|
| 1 | 100 | 0.7 | 1756 | 1 |
| 2 | 100 | 0.6 | 1707 | 2 |
| 3 | 100 | 0.5 | 1752 | 4 |
| 4 | 100 | 1.1 | 1765 | >336 |
| 5 | 100 | 1.4 | 1715 | >336 |
| 6 | 100 | 1.7 | 1774 | 8 |
| 7 | 100 | 1.2 | 1693 | 4 |
| 8 | 100 | 1.5 | 1776 | 4 |

The results in Tables 1 to 3 teach as follows. Nos. 4 to 6 demonstrated large tensile strength and excellent delayed fraction resistance, since all of them satisfied the component composition specified by the embodiments of the present invention, and were manufactured under the recommended conditions to obtain a desired metallographic structure. In contrast, Nos. 1 to 3, 7, and 8 were found to be inferior in at least either the tensile strength or the delayed fracture resistance, since they did not satisfy the specified component composition, or since they were not manufactured under the recommended conditions, and thus failed to obtain the specified metallographic structure. Details are given below.

No. 1, with use of a steel sheet short of C content, and having not gone through the tempering in the heat treatment process, was found to fail in keeping a predetermined content of the transition metal carbide, and to result in poor delayed fracture resistance.

No. 2, with use of a steel sheet short of C content, and having not gone through the tempering so as to satisfy the tempering parameter, was found to fail in keeping a predetermined content of the transition metal carbide, and to result in poor delayed fracture resistance.

No. 3, with the C content larger than those in Nos. 1 and 2 but still in shortage, and having not gone through the tempering so as to satisfy the tempering parameter, was found to fail in keeping a predetermined content of the transition metal carbide, and to result in poor delayed fracture resistance.

No. 7, with use of a steel sheet that satisfies the specified component composition, but having not gone through the tempering under the recommended conditions, was found to result in poor tensile strength and poor delayed fracture resistance.

No. 8, with use of a steel sheet having an excessive C content, and having not gone through the tempering under the recommended conditions, was found to result in poor delayed fracture resistance.

This application claims priority based on Japanese Patent Application No. 2020-007808, filed on Jan. 21, 2020. Japanese Patent Application No. 2020-007808 is incorporated herein by reference.

The invention claimed is:

1. A steel sheet, comprising:

C: 0.280 mass % or more and 0.404 mass % or less;
Si: 0 mass % or more and 0.6 mass % or less;
Mn: more than 0 mass % and 1.5 mass % or less;
Al: more than 0 mass % and 0.15 mass % or less;
B: more than 0 mass % and 0.01 mass % or less;
Cu: more than 0 mass % and 0.5 mass % or less;
Ni: more than 0 mass % and 0.5 mass % or less;
Ti: more than 0 mass % and 0.20 mass % or less;
N: more than 0 mass % and 0.01 mass % or less;
P: more than 0 mass % and 0.02 mass % or less;
S: more than 0 mass % and 0.01 mass % or less;
with the balance comprising Fe and inevitable impurities,
the steel sheet having a martensite structure whose ratio accounts for 95 area % or more of entire metallographic structure of the steel sheet,
the steel sheet having a transition metal carbide whose ratio accounts for 0.8 volume % or more of the entire metallographic structure of the steel sheet, and
the steel sheet having a tensile strength of 1700 MPa or larger.

2. The steel sheet according to claim 1, comprising at least one of (a) to (c):

(a) further comprising Cr: more than 0 mass % and 1.0 mass % or less;
(b) further comprising at least one selected from the group consisting of
V: more than 0 mass % and 0.1 mass % or less,
Nb: more than 0 mass % and 0.1 mass % or less, and
Mo: more than 0 mass % and 0.5 mass % or less; and
(c) further comprising one or two of
Ca: more than 0 mass % and 0.005 mass % or less, and
Mg: more than 0 mass % and 0.005 mass % or less.

* * * * *